United States Patent [19]

Moriyama et al.

[11] 4,182,614

[45] Jan. 8, 1980

[54] SURFACE ACTIVE AGENT FOR EMULSION FUEL

[75] Inventors: Noboru Moriyama; Yoshio Aoki, both of Wakayama; Yukihiro Furuyama, Naga, all of Japan

[73] Assignee: Kao Soap Co., Ltd., Tokyo, Japan

[21] Appl. No.: 912,924

[22] Filed: Jun. 5, 1978

[30] Foreign Application Priority Data

Jun. 14, 1977 [JP] Japan ..... 52-70093

[51] Int. Cl.[2] ..... C10L 1/32

[52] U.S. Cl. ..... 44/51; 252/309

[58] Field of Search ..... 44/51; 252/309, 312, 252/356

[56] References Cited

U.S. PATENT DOCUMENTS

| | | | |
|---|---|---|---|
| 2,661,334 | 12/1953 | Lummus | 252/309 |
| 2,744,870 | 5/1956 | Stillebroer et al. | 252/309 |
| 3,540,866 | 11/1970 | Miller | 44/51 |
| 3,966,632 | 6/1976 | Colliopoulos | 252/309 |

OTHER PUBLICATIONS

"Calculation of HLB Values of Non-ionic Surfactants", The American Perfumer and Essential Oil Review, William C. Griffin, May, 1955, pp. 26–29.

*Primary Examiner*—Delbert E. Gantz
*Assistant Examiner*—Y. Harris-Smith
*Attorney, Agent, or Firm*—Blanchard, Flynn, Thiel, Boutell & Tanis

[57] ABSTRACT

Emulsion fuels can be effectively emulsified with a very small amount of a compound of the formula:

$$\begin{array}{l} CH_2O(C_2H_4O)_{n1}X \\ | \\ CHO(C_2H_4O)_{n2}X \\ | \\ CH_2O(C_2H_4O)_{n3}X \end{array}$$

wherein at least 1.25 on the average of the 3 X's stand for an acyl group having 10 to 18 carbon atoms, the remainder being a hydrogen atom, and the sum of numbers n1, n2 and n3 is in the range of from 2 to 50.

6 Claims, No Drawings

SURFACE ACTIVE AGENT FOR EMULSION FUEL

BACKGROUND OF THE INVENTION

1. Field of the Invention

The present invention relates to a surface active agent for emulsion fuels. More particularly, the present invention relates to a surface active agent which is suitably used when a water-in-oil type emulsion fuel is prepared by adding water and a surface active agent to a fuel oil such as kerosine or heavy oil for the purpose of reducing the concentration of nitrogen oxides ($NO_x$) in an exhaust gas discharged from a boiler, a heating furnace or the like.

2. Description of Prior Arts

It is known that $NO_x$ and other pollutants generated by combustion of various fuel oils cause air pollution. As means for preventing occurrence of this undesirable phenomenon, there have been proposed various methods for reducing the amount of $NO_x$ discharged into the open air. These methods are roughly divided into two types. According to the method of one type, generation of $NO_x$ is controlled, and according to the method of the other type, generated $NO_x$ is removed (called "denitration method"). According to one embodiment of the first-mentioned type of known methods for controlling generation of $NO_x$, the structure of a burner or combustion chamber is improved or the combustion exhaust gases are recycled, namely the combustion system per se is improved. According to a second embodiment of the first-mentioned type of known methods for controlling generation of $NO_x$, the kind of fuel to be used is changed or water or other additive is added to the fuel prior to or at combustion, namely the fuel per se is improved.

$NO_x$ is a term used to indicate both NO and $NO_2$, and it is said that about 95% of $NO_x$ in a boiler exhaust gas is NO. $NO_x$ in the exhaust gas is divided into $NO_x$ generated from nitrogen-containing components contained in fuel oil, such as pyridine, pyrrole, quinoline and the like (called "fuel $NO_x$"), and $NO_x$ generated by reaction between $N_2$ and $O_2$ in air at combustion (called "thermal $NO_x$"). The concentrations of both the fuel $NO_x$ and the thermal $NO_x$ are increased as the temperature is elevated, and it is known that the concentration of thermal $NO_x$ is increased especially prominently at temperatures higher than 1500°-1600° C.

In the case of a water-in-oil type emulsion fuel formed by emulsifying water in the liquid fuel by a surface active agent, it is said that the amount of $NO_x$ generated by combustion is controlled according to the following three principles.

(1) Generation of $NO_x$ is greatly influenced by the combustion temperature and it can be controlled by lowering of the combustion temperature. In the case of an emulsion fuel, the combustion temperature is lowered by evaporation of water and generation of $NO_x$ is controlled.

(2) Fine fuel particles are made much finer owing to an abrupt expansion of the volume caused by evaporation of the water drops dispersed in an emulsion fuel. Accordingly, the contact area between the oil drops and air is increased and the ratio of air/fuel oil (kerosine or heavy oil) can be reduced, and the use of a low excess of air for combustion becomes possible. As a result, generation of $NO_x$ can be controlled. In general, the air/fuel ratio is brought close to 1, the concentrations of excess $N_2$ and $O_2$ at combustion are reduced and hence, the speed of formation of $NO_x$ (especially thermal $NO_x$) is lowered and generation of $NO_x$ can be controlled.

(3) In an emulsion fuel, water is uniformly dispersed (emulsified), and when water is evaporated, the flame surface temperature is lowered by latent heat of water and simultaneously, local temperature elevation is prevented. Further, since fuel particles are made much finer in the emulsion fuel as pointed out in (2) above, local elevation of the temperature is prevented. As a result, generation of $NO_x$ can be controlled.

As the fuel formed by incorporating water into fuel oil, in addition to the above-mentioned emulsion oil, there can be mentioned a fuel formed by jetting water vapor into fuel oil and a fuel formed by jetting water into fuel oil. When these fuels are used or combustion methods using these fuels are adopted, the effect of controlling generation of $NO_x$ is considerably lower than the effect attained by an emulsion fuel. The reason is considered to be that in these fuels, water drops are not uniformly dispersed (emulsified) in the fuel oil or the particle size of the water drops is large. Further, these fuels are inferior with respect to the combustion stability.

In general, emulsions are evaluated based on the ease in emulsification and the stability of the emulsion. Emulsion fuels are burnt just after preparation thereof. Accordingly, in the case of emulsion fuels, ease in emulsification is important and a stability such that the emulsion is stable for 5 to 10 minutes or about 30 minutes at longest is sufficient for ordinary application.

When emulsion fuels are prepared, a surface active agent (surfactant) is ordinarily used in an amount of 1 to 10% by weight based on the total system (oil + water). When an emulsion fuel formed by using an appropriate commercially available surfactant, for example, polyoxyethylene nonylphenyl ether, polyoxyethylene dodecyl ether or polyoxyethylene sorbitan laurate in an amount of 1 to 10% by weight (based on the total system) is used as a fuel for a boiler, the concentration of $NO_x$ generated is much reduced as compared with the $NO_x$ concentration observed when the fuel oil alone is used. However, an emulsion fuel prepared by using such a large amount of a surfactant is very expensive and from the economical viewpoint, such an emulsion fuel is not hardly put into practical use.

SUMMARY OF THE INVENTION

Under such background, we have found a surface active agent which shows excellent properties as a surfactant for an emulsion fuel even if it is used in a very small amount, and based on this finding, we have now completed the present invention. More specifically, in accordance with the present invention, there is provided a surface active agent for emulsion fuels, which comprises a compound represented by the following general formula (1):

$$\begin{array}{l} CH_2O(C_2H_4O)_{n1}X \\ | \\ CHO(C_2H_4O)_{n2}X \\ | \\ CH_2O(C_2H_4O)_{n3}X \end{array} \qquad (1)$$

wherein at least 1.25 on the average of the 3 X's stand for an acyl group having 10 to 18 carbon atoms, the remainder being a hydrogen atom, and the sum of numbers n1, n2 and n3 is in the range of from 2 to 50.

As the acyl group, there may be most preferably used lauric group and oleic group.

When a water-in-oil type emulsion fuel formed by incorporating the surface active agent of the present invention in an amount of 0.05 to 0.5% by weight (all references to "%" given hereinafter are by weight unless otherwise indicated), preferably 0.1 to 0.4%, based on the total system (fuel oil + water) is used as a fuel for a boiler, generation of $NO_x$ is prominently controlled as compared with the case of fuel oil alone (water is not incorporated) or an emulsion fuel prepared in the same manner as above by incorporating a commercially available surface active agent in an amount of 0.03 to 0.7%. In the case of commercially available surface active agents, no substantial effect of controlling generation of $NO_x$ can be attained unless they are incorporated in amounts of at least 1%, for example, 5%, based on the total system. Namely, in case of an emulsion fuel prepared by using the surface active agent of the present invention, a higher effect of controlling generation of $NO_x$ can be attained with the use of a smaller amount of the surface active agent, compared with emulsion fuels prepared by using commercially available ordinary surface active agents.

When an emulsion fuel is prepared by using the surface active agent of the present invention, it is preferred that the proportion of water to fuel oil be 5 to 40% by weight.

As the fuel oil to which the surface active agent of the present invention can be applied, there can be mentioned, for example, kerosine and heavy oil.

Emulsion fuels including the surface active agent of the present invention can be prepared according to various methods. For example, there may be adopted a method in which the surface active agent of the present invention is dissolved in fuel oil, water is added to the solution and the resulting mixture is agitated, or a method in which the surface active agent of the present invention is dispersed or dissolved in water, the dispersion or solution is added to fuel oil and the mixture is agitated. Any agitators having a sufficient agitating effect can be used for the preparation of emulsion fuels. For example, there can be used an agitator such as a propeller type agitator, a mixer, a homogenizer and the like.

The present invention will now be described in detail by reference to the following Examples that by no means limit the scope of the present invention.

EXAMPLE 1

At room temperature, 80 parts by weight (all of references to "parts" given below are by weight unless otherwise indicated) of kerosine (N content=0.015%; product of Quignus Oil), 20 parts of water and a predetermined amount of a surface active agent were agitated by an appropriate agitator (for example, a line mixer) to form a water-in-oil type emulsion (emulsion fuel), and this emulsion was used as a fuel for a boiler. The $NO_x$ and $O_2$ contents in the exhaust gas from the boiler were determined by an apparatus for measuring the nitrogen oxide concentration in an exhaust gas (Yanagimoto Apparatus Model ECL-77) and an apparatus for measuring the oxygen concentration in an exhaust gas (Yanagimoto Apparatus Model EMG-77). The $NO_x$ content was evaluated based on the conversion value to 4% $O_2$. The $NO_x$ values obtained when the emulsion fuel and kerosine alone were used under the same boiler load at the same air/kerosine ratio were compared with each other, and the degree of reduction of the $NO_x$ value by the emulsion fuel was calculated.

In Table 1, there are shown data of the emulsified particle diameter, the emulsion state, the $NO_x$ reduction ratio and the amount of the surface active agent used in emulsion fuels prepared by using samples of the present invention and comparative samples.

Table 1

| Sample No. | Surfactant | Amount (% by weight based on total system) of Surfactant | Particle Size* | Emulsion State** | $NO_x$ Reduction Ratio*** (%) | Remarks |
|---|---|---|---|---|---|---|
| Comparative Samples | | | | | | |
| 1 | $C_{11}H_{23}COO(C_2H_4O)_6H$ | 0.3 | 1 | 1 | 18 | Wide variation of $NO_x$ value |
| | " | 0.5 | 1 | 1 | 12 | Wide variation of $NO_x$ value |
| | " | 0.7 | 2 | 2 | 18 | Wide variation of $NO_x$ value |
| | " | 1.0 | 3 | 3 | 25 | |
| 2 | sorbitan monoluarate | 0.3 | 1 | 1 | 13 | Wide variation of $NO_x$ value |
| | " | 0.5 | 2 | 2 | 20 | Wide variation of $NO_x$ value |
| | " | 0.7 | 3 | 3 | 25 | |
| | " | 1.0 | 4 | 4 | 41 | |
| 3 | glycerol monolaurate | 0.3 | 2 | 2 | 21 | |
| | " | 0.5 | 3 | 3 | 32 | |
| | " | 0.7 | 4 | 4 | 41 | |
| | " | 1.0 | 5 | 4 | 46 | |
| 4 | monolaurate of adduct of ethylene oxide (3 moles) to glycerol | 0.3 | 1 | 1 | 20 | Wide variation of $NO_x$ value |
| | monolaurate of adduct of ethylene oxide (3 moles) to glycerol | 0.5 | 2 | 2 | 17 | Wide variation of $NO_x$ value |
| | monolaurate of adduct of ethylene oxide (3 moles) to glycerol | 0.7 | 2 | 2 | 23 | |
| | monolaurate of adduct of ethylene oxide (3 moles) to glycerol | 1.0 | 3 | 3 | 27 | |

Table 1-continued

| Sample No. | Surfactant | Amount (% by weight based on total system) of Surfactant | Particle Size* | Emulsion State** | $NO_x$ Reduction Ratio*** (%) | Remarks |
|---|---|---|---|---|---|---|
| Samples of Present Invention | | | | | | |
| 5 | sesquilaurate of adduct of ethylene oxide (3 moles) to glycerol | 0.1 | 3 | 2 | 25 | |
| | sesquilaurate of adduct of ethylene oxide (3 moles) to glycerol | 0.2 | 4 | 3 | 36 | |
| | sesquilaurate of adduct of ethylene oxide (3 moles) to glycerol | 0.4 | 5 | 4 | 45 | |
| | sesquilaurate of adduct of ethylene oxide (3 moles) to glycerol | 0.6 | 5 | 4 | 50 | |
| 6 | dilaurate of adduct of ethylene oxide (3 moles) to glycerol | 0.1 | 3 | 2 | 22 | |
| | dilaurate of adduct of ethylene oxide (3 moles) to glycerol | 0.2 | 4 | 3 | 35 | |
| | dilaurate of aduct of ethylene oxide (3 moles) to glycerol | 0.4 | 5 | 4 | 46 | |
| | dilaurate of adduct of ethylene oxide (3 moles) to glycerol | 0.6 | 5 | 4 | 52 | |
| 7 | trilaurate of adduct of ethylene oxide (3 moles) to glycerol | 0.1 | 3 | 2 | 25 | |
| | trilaurate of adduct of ethylene oxide (3 moles) to glycerol | 0.2 | 5 | 3 | 39 | |
| | trilaurate of adduct of ethylene oxide (3 moles) to glycerol | 0.4 | 5 | 4 | 48 | |
| | trilaurate of adduct of ethylene oxide (3 moles) to glycerol | 0.6 | 5 | 4 | 51 | |
| Samples of Present Invention | | | | | | |
| 8 | trilaurate of adduct of ethylene oxide (6 moles) to glycerol | 0.1 | 3 | 2 | 20 | |
| | trilaurate of adduct of ethylene oxide (6 moles) to glycerol | 0.2 | 4 | 3 | 32 | |
| | trilaurate of adduct of ethylene oxide (6 moles) to glycerol | 0.4 | 5 | 4 | 43 | |
| | trilaurate of adduct of ethylene oxide (6 moles) to glycerol | 0.6 | 5 | 4 | 48 | |
| 9 | trilaurate of adduct of ethylene oxide (10 moles) to glycerol | 0.1 | 2 | 2 | 22 | |
| | trilaurate of adduct of ethylene oxide (10 moles) to glycerol | 0.2 | 3 | 2 | 25 | |
| | trilaurate of adduct of ethylene oxide (10 moles) of glycerol | 0.4 | 5 | 3 | 38 | |
| | trilaurate of adduct of ethylene oxide (10 moles) to glycerol | 0.6 | 5 | 4 | 45 | |
| 10 | trioleate of adduct of ethylene oxide (10 moles) to glycerol | 0.1 | 3 | 2 | 21 | |
| | trioleate of adduct of ethylene oxide (10 moles) to glycerol | 0.2 | 4 | 3 | 34 | |
| | trioleate of adduct of ethylene oxide (10 moles) to glycerol | 0.4 | 5 | 4 | 43 | |
| | trioleate of adduct of ethylene oxide (10 moles) to glycerol | 0.6 | 5 | 4 | 48 | |
| 11 | trioleate of adduct of ethylene oxide (20 moles) to glycerol | 0.1 | 2 | 2 | 18 | |
| | trioleate of adduct of ethylene oxide (20 moles) to glycerol | 0.2 | 3 | 2 | 25 | |
| | trioleate of adduct of ethylene oxide (20 moles) to glycerol | 0.4 | 5 | 3 | 34 | |
| | trioleate of adduct of ethylene | 0.6 | 5 | 4 | 43 | |

Table 1-continued

| Sample No. | Surfactant | Amount (% by weight based on total system) of Surfactant | Particle Size* | Emulsion State** | $NO_x$ Reduction Ratio*** (%) | Remarks |
|---|---|---|---|---|---|---|
| | oxide (20 moles) to glycerol | | | | | |

Note
*The average particle size of dispersed particles (water drops) was calculated by examination of a microscopic photograph, and was evaluated according to the following scale:
5: 1 to 5 μ
4: 5 to 10 μ
3: 10 to 20 μ
2: 20 to 50 μ
1: larger than 50 μ
**The whiteness of the emulsion was examined with the naked eye and was evaluated based on values of from 1 to 4. A larger value indicates a better emulsion state, and value 1 indicates the same color as that of fuel oil.
***Amounts (converted to 4% $O_2$) of $NO_x$ generated by combustion of fu. oil alone and the emulsion fuel at the same air/fuel oil ratio (about 1.2) under the same boiler load were compared, and the ratio of reducti.. to the value obtained at combustion of fuel oil alone was determined.

EXAMPLE 2

At room temperature, 100 parts of heavy oil No. 1 specified by the Japanese Industrial Standard (heavy oil A, N content=0.08%), 20 parts of water and a predetermined amount of a surfactant were agitated in the same manner as described in Example 1 to form an emulsion fuel. The emulsion fuel was used as a fuel for a boiler, and according to the methods described in Example 1, $NO_x$ and $O_2$ contents were measured and the degree of reduction of the $NO_x$ content by the emulsion fuel over heavy oil A alone was calculated to obtain results shown in Table 2.

Table 2

| Surfactant | Amount (% by weight based on total system) of Surfactant | Particle Size* | Emulsion State** | $NO_x$ Reduction Ratio*** (%) | Remarks |
|---|---|---|---|---|---|
| Comparative Samples | | | | | |
| Sample No. 1 on Table 1 | 0.3 | 1 | 1 | 7 | Wide variation of $NO_x$ value |
| " | 0.5 | 1 | 1 | 8 | Wide variation of $NO_x$ value |
| " | 1.0 | 2 | 2 | 15 | Wide variation of $NO_x$ value |
| " | 2.0 | 3 | 3 | 18 | |
| Sample No. 3 on Table 1 | 0.3 | 3 | 2 | 22 | |
| " | 0.5 | 5 | 4 | 39 | |
| " | 0.6 | 5 | 4 | 43 | |
| " | 0.7 | 5 | 4 | 47 | |
| Sample No. 4 on Table 1 | 0.3 | 2 | 1 | 18 | Wide variation of $NO_x$ value |
| " | 0.5 | 4 | 3 | 23 | |
| " | 0.6 | 5 | 3 | 28 | |
| " | 0.7 | 5 | 4 | 38 | |
| Samples of Present Invention | | | | | |
| sesquilaurate of adduct of ethylene oxide (10 moles) to glycerol | 0.1 | 2 | 2 | | 20 |
| Sesquilaurate of adduct of ethylene oxide (10 moles) to glycerol | 0.2 | 4 | 2 | | 29 |
| Sesquilaurate of adduct of ethylene oxide (10 moles) to glycerol | 0.3 | 5 | 3 | | 36 |
| sesquilaurate of adduct of ethylene oxide (10 moles) to glycerol | 0.5 | 5 | 4 | | 44 |
| dilaurate of adduct of ethylene oxide (10 moles) to glycerol | 0.1 | 2 | 2 | | 23 |
| dilaurate of adduct of ethylene oxide (10 moles) to glycerol | 0.2 | 4 | 2 | | 31 |
| dilaurate of adduct of ethylene oxide (10 moles) to glycerol | 0.3 | 5 | 4 | | 40 |
| dilaurate of adduct of ethylene oxide (10 moles) to glycerol | 0.5 | 5 | 4 | | 47 |
| trilaurate of adduct of ethylene oxide (20 moles) to glycerol | 0.1 | 2 | 2 | | 17 |
| trilaurate of adduct of ethylene oxide (20 moles) to glycerol | 0.2 | 4 | 2 | | 29 |

Table 2-continued

| Surfactant | Amount (% by weight based on total system) of Surfactant | Particle Size* | Emulsion State** | $NO_x$ Reduction Ratio*** (%) | Remarks |
|---|---|---|---|---|---|
| trilaurate of adduct of ethylene oxide (20 moles) to glycerol | 0.3 | 5 | 3 | | 37 |
| trilaurate of adduct of ethylene oxide (20 moles) to glycerol | 0.5 | 5 | 4 | | 43 |
| Sample No. 11 on Table 1 | 0.1 | 2 | 2 | | 20 |
| " | 0.2 | 4 | 2 | | 28 |
| "0.3 | 5 | 3 | 35 | | |
| " | 0.5 | 5 | 4 | | 42 |

Note
*same as in Example 1
**same as in Example 1
***same as in Example 1

EXAMPLE 3

At a temperature of 80° to 90° C., 100 parts of heavy oil No. 3-2 specified by the Japanese Industrial Standard (heavy oil C, N content = 0.21%), 20 parts of water and a predetermined amount of a surfactant were agitated in the same manner as described in Example 1 to prepare an emulsion fuel. This emulsion fuel was used as a fuel for a boiler. According to the methods described in Example 1, the $NO_x$ and $O_2$ contents in an exhaust gas from the boiler were measured, and the degree of reduction of the $NO_x$ content by the emulsion fuel over heavy oil A alone was calculated to obtain results shown in Table 3.

Table 3

| Surfactant | Amount (% by weight based on total system) of Surfactant | Particle Size* | Emulsion State** | $NO_x$ Reduction Ratio*** (%) | Remarks |
|---|---|---|---|---|---|
| Comparative Samples | | | | | |
| Sample No. 1 on Table 1 | 0.3 | 1 | 1 | 17 | Wide variation of $NO_x$ value |
| " | 0.5 | 1 | 1 | 13 | Wide variation of $NO_x$ value |
| " | 0.7 | 3 | 1 | 15 | |
| " | 1.0 | 4 | 1 | 27 | |
| Sample No. 3 on Table 1 | 0.3 | 3 | 1 | 16 | |
| " | 0.5 | 5 | 1 | 35 | |
| " | 0.6 | 5 | 2 | 38 | |
| " | 0.7 | 5 | 2 | 43 | |
| Sample No. 4 on Table 1 | 0.3 | 2 | 1 | 18 | |
| " | 0.5 | 4 | 1 | 25 | |
| " | 0.6 | 5 | 1 | 32 | |
| " | 0.7 | 5 | 2 | 38 | |
| Samples of Present Invention | | | | | |
| sesquilaurate of adduct of ethylene oxide (15 moles) to glycerol | 0.1 | 2 | 1 | 15 | |
| sesquilaurate of adduct of ethylene oxide (15 moles) to glycerol | 0.2 | 3 | 1 | 23 | |
| sesquilaurate of adduct of ethylene oxide (15 moles) to glycerol | 0.3 | 4 | 1 | 27 | |
| sesquilaurate of adduct of ethylene oxide (15 moles) to glycerol | 0.5 | 5 | 2 | 40 | |
| dilaurate of adduct of ethylene oxide (15 moles) to glycerol | 0.1 | 2 | 1 | 18 | |
| dilaurate of adduct of ethylene oxide (15 moles) to glycerol | 0.2 | 3 | 1 | 23 | |
| dilaurate of adduct of ethylene oxide (15 moles) to glycerol | 0.3 | 4 | 1 | 29 | |
| dilaurate of adduct of ethylene oxide (15 moles) to glycerol | 0.5 | 5 | 2 | 41 | |
| trilaurate of adduct of ethylene oxide (20 moles) to glycerol | 0.1 | 2 | 1 | 20 | |
| trilaurate of adduct of ethylene oxide (20 moles) to glycerol | 0.2 | 3 | 1 | 25 | |
| trilaurate of adduct of ethylene oxide (20 moles) to glycerol | 0.3 | 5 | 1 | 32 | |
| trilaurate of adduct of ethylene oxide (20 moles) to glycerol | 0.5 | 5 | 2 | 43 | |
| trilaurate of adduct of ethylene oxide (30 moles) to glycerol | 0.1 | 2 | 1 | 17 | |
| trilaurate of adduct of ethylene oxide (30 moles) to glycerol | 0.3 | 3 | 1 | 23 | |
| trilaurate of adduct of ethylene oxide (30 moles) to glycerol | 0.5 | 5 | 1 | 30 | |
| trilaurate of adduct of ethylene | | | | | |

Table 3-continued

| Surfactant | Amount (% by weight based on total system) of Surfactant | Particle Size* | Emulsion State** | $NO_x$ Reduction Ratio*** (%) | Remarks |
|---|---|---|---|---|---|
| oxide (30 moles) to glycerol | 0.7 | 5 | 2 | 43 | |

Note
*same as in Example 1
**same as in Example 1
***same as in Example 1

EXAMPLE 4

In 100 parts of kerosine, heavy oil A or heavy oil C as the fuel oil was incorporated 5 to 30% by weight of water, and an emulsion fuel was prepared according to the method described in Example 1.

This emulsion fuel was used as a fuel for a boiler. According to the methods described in Example 1, the $NO_x$ and $O_2$ contents in an exhaust gas from the boiler were measured, and the degree of reduction of the $NO_x$ content by the emulsion fuel over fuel oil alone was calculated to obtain results shown in Table 4. The surfactant was used in an amount of 0.5% by weight based on the total system.

Table 4

| Fuel Oil | Surfactant | Amount (% by weight based on total system) of Surfactant | Particle Size* | Emulsion State** | $NO_X$ Reduction Ratio*** (%) |
|---|---|---|---|---|---|
| kerosine | Sample No. 7 on Table 1 | 5 | 5 | 3 | 20 |
| " | " | 10 | 5 | 4 | 26 |
| " | " | 20 | 5 | 4 | 45 |
| " | " | 40 | 5 | 4 | 59 |
| heavy oil A | Sample No. 10 on Table 1 | 5 | 5 | 3 | 12 |
| " | " | 10 | 5 | 4 | 19 |
| " | " | 20 | 5 | 4 | 39 |
| " | " | 30 | 5 | 4 | 47 |
| heavy oil C | Sample No. 11 on Table 1 | 5 | 5 | 1 | 10 |
| " | " | 10 | 5 | 1 | 13 |
| " | " | 20 | 5 | 2 | 31 |
| " | " | 30 | 5 | 3 | 39 |

Note
*same as in Example 1
**same as in Example 1
***same as in Example 1

The embodiments of the invention in which an exclusive property or privelege is claimed are defined as follows:

1. In a method for preparing a water-in-oil emulsion fuel which comprises emulsifying water in oil, in the presence of an emulsifying agent, the improvement which comprises using, as the emulsifying agent, surfactant having the formula:

$$\begin{array}{l} CH_2O(C_2H_4O)_{n1}X \\ | \\ CHO(C_2H_4O)_{n2}X \\ | \\ CH_2O(C_2H_4O)_{n3}X \end{array}$$

wherein at least 1.25 on the average of the three X's are lauroyl or oleoyl and the remaining X's are hydrogen, and the sum of the numbers n1, n2 and n3 is in the range of from 2 to 50.

2. A method as claimed in claim 1, in which said surfactant is used in an amount of 0.05 to 0.5% by weight, based on the total weight of water and oil.

3. A method as claimed in claim 1 in which said surfactant is used in an amount of 0.1 to 0.4% by weight, based on the total weight of oil and water.

4. A method as claimed in claim 1, in which the emulsion fuel consists essentially of from 5 to 40% by weight of water and from 95 to 60% by weight of oil.

5. A method as claimed in claim 1 in which the oil is kerosine or heavy oil.

6. A water-in-oil emulsion fuel consisting essentially of from 5 to 40% by weight of water, from 95 to 60% by weight of fuel oil, and from 0.05 to 0.5% by weight, based on the combined weights of said water and said fuel oil, of surfactant having the formula $$\begin{array}{l} CH_2O(C_2H_4O)_{n1}X \\ | \\ CHO(C_2H_4O)_{n2}X \\ | \\ CH_2O(C_2H_4O)_{n3}X \end{array}$$

wherein at least 1.25 on the average of the 3 X's are lauroyl or oleoyl and the remaining X's are hydrogen, and the sum of the numbers n1, n2 and n3 is from 2 to 50.

* * * * *